US006583098B1

(12) United States Patent
Cassie

(10) Patent No.: US 6,583,098 B1
(45) Date of Patent: Jun. 24, 2003

(54) DETERGENT COMPOSITION

(75) Inventor: Leslie Hugh Cassie, Morpeth (GB)

(73) Assignee: The Procter & Gamble Company, Cincinnati, OH (US)

( * ) Notice: Subject to any disclaimer, the term of this patent is extended or adjusted under 35 U.S.C. 154(b) by 14 days.

(21) Appl. No.: 09/979,497

(22) PCT Filed: Jun. 20, 2000

(86) PCT No.: PCT/US00/17006

§ 371 (c)(1),
(2), (4) Date: Nov. 14, 2001

(87) PCT Pub. No.: WO00/78915

PCT Pub. Date: Dec. 28, 2000

Related U.S. Application Data

(60) Provisional application No. 60/140,080, filed on Jun. 21, 1999.

(30) Foreign Application Priority Data

Jun. 28, 1999 (GB) ..... 9914983

(51) Int. Cl.[7] ..... C11D 3/00; C11D 7/18; C11D 7/54; C11D 17/00

(52) U.S. Cl. ..... 510/376; 510/444

(58) Field of Search ..... 510/375, 376, 510/444

(56) References Cited

U.S. PATENT DOCUMENTS 4,399,049 A 8/1983 Gray et al.
4,567,010 A * 1/1986 Hutton et al. ..... 264/117
4,678,594 A 7/1987 Parfomak et al.
4,707,307 A * 11/1987 Hutton et al. ..... 260/502 R
5,091,106 A 2/1992 Jacobs et al.
5,902,781 A 5/1999 Painter
6,294,512 B1 * 9/2001 Mort et al. ..... 510/148

FOREIGN PATENT DOCUMENTS

| | | |
|---|---|---|
| EP | 0 299 599 A1 | 1/1989 |
| EP | 0 592 033 A1 | 4/1994 |
| WO | WO 97/18289 | 5/1997 |

* cited by examiner

*Primary Examiner*—Necholus Ogden
*Assistant Examiner*—John M Petruncio

(57) ABSTRACT

Particulate detergent components comprising a bleaching agent and detergent compositions containing them are described. The invention relates to the problem of localised build-up of bleaching components and provides bleaching granules comprising no more than 50 wt. % of a particulate bleach component selected from bleach activators, pre-formed peracids, bleach catalysts and mttres thereof, in addition to further detergent ingredients. The geometric mean particle diameter of the particulate bleach component is below 500 $\mu$m. A method for making a bleach granule comprises in a mixing step, mixing the particulate bleach component with builders and/or surfactants and optionally other detergent ingredients and/or fillers in a high, moderate or low shear mixer to produce the bleach granules. Preferably, the bleach granules are produced in a moderate to low shear mixer.

13 Claims, No Drawings

DETERGENT COMPOSITION

This application claims benefit of aplication Ser. No. 60/140,080 filed Jun. 21, 1999.

FIELD OF THE INVENTION

This invention relates to particulate detergent components and improved detergent compositions containing them. The detergent compositions of the invention are suitable for any purpose, however, the invention is particularly directed to laundry detergent compositions. These may be used directly in their particulate form or may be formed into detergent tablets, for example, by compaction or any other standard tabletting process.

BACKGROUND OF THE INVENTION

It is well known that detergent compositions which comprise bleaching components may be problematic where localised concentrations of bleaching agent contact clothes. This is a particular problem in detergent products which do not dispense well or which have a tendency to gel on contact with water. Such gels tend to be exacerbated by the presence of highly viscous surfactant phases that may arise when the detergent comes into contact with water either in a dispensing drawer or in the washing machine or in a dispensing device which is placed into the drum of the machine. Bleaching agent trapped in such gels tends to form localised high concentrations of bleach which can cause local damage to fabrics, either in terms of damage to dyed fabrics or damage to the fabric strength. Many solutions have been proposed to try to overcome this problem. For example, in EP-A-652930 peroxy acid bleach precursors are incorporated into detergent compositions in an acid coated form. Coating processes are however inconvenient and alternative methods for producing highly effective bleaching in detergent compositions whilst minimising fabric damage are still required. The present invention is therefore aimed at the problem of providing a method for reducing fabric damage in bleach-containing detergent compositions. The invention may also enable the effectiveness of the incorporated bleaching agents to be maximised.

SUMMARY OF THE INVENTION

In accordance with the present invention there is now provided a bleaching granule for incorporation into a detergent composition comprising (a) no more than 50 wt % of a particulate bleaching component selected from bleach activator or bleach catalyst, and (b) builder and/or surfactant and optional detergent ingredients and/or fillers, the geometric mean particle diameter of the particulate bleach component being below 500 $\mu$m.

The present invention also relates to detergent compositions comprising such bleaching granules and to a process for making these bleaching granules comprising in a mixing step, mixing the bleaching component with builders and/or surfactants and optionally other detergent ingredients or fillers in a high, moderate or low shear mixer. The preferred mixing step comprises a moderate or low shear mixing step.

DETAILED DESCRIPTION OF THE INVENTION

The particulate bleach component which is selected from bleach activators, bleach catalysts or pre-formed peroxy acid bleaches may be in the form of solid particulate raw material or may comprise the bleach component carried on a solid support or as an encapsulate. In one preferred embodiment of the invention, the particulate bleach component is a particulate raw material such that it has an activity greater than 90%, preferably greater than 95%. Preferably the bleach component comprises bleach activator which is preferably an organic peroxy acid bleach precursor. The bleach component may comprise mixtures of more than one bleach activator or mixtures of bleach activator and bleach catalysts. Preferred mixtures of bleach activators comprise one hydrophobic peroxy acid bleach precursor and one hydrophilic peroxy acid bleach precursor. The production of the organic peroxy acid occurs then by an in-situ reaction in the wash water of the precursor with a source of hydrogen peroxide.

Peroxy acid bleach precursors suitable for use in the present invention may be represented as

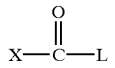

where L is a leaving group and X is essentially any functionality, such that on perhydrolysis the structure of the peroxyacid produced is

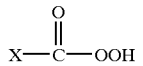

The bleaching component which preferably comprises peroxyacid bleach precursor compounds are preferably incorporated at a level of from 0.5% to 20% by weight, more preferably from 1% to 15% by weight, most preferably from 1.5% to 10% by weight of the detergent granule.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching granule or tablet.

Preferred L groups are selected from the group consisting of:

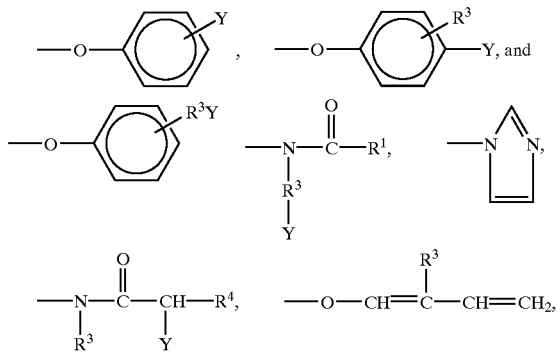

-continued

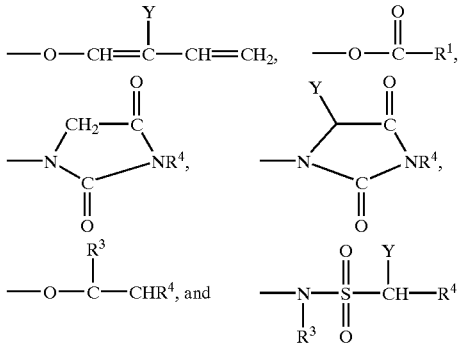

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any finctional group including, for example alkyl, hydroxy, alkoxy, halogen, amine, nitrosyl, amide and ammonium or alkyl ammmonium groups.

The preferred solubilizing groups are $—SO_3^-M^+$, $-CO_2^-M^+$, $-SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N—,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose, DOBS, LOBS and/or NACA-OBS.

Amide Substituted Alkyl Peroxyacid Precursors

Suitable amide substituted alkyl peroxyacid precursor compounds include those of the following general formulae:

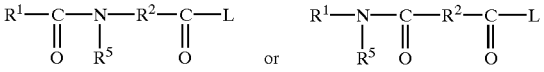

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Preformed Organic Peroxyacid

Alternatively, or in addition, the detergent granule may contain a preformed organic peroxyacid, typically at a level of from 1% to 15% by weight, more preferably from 1% to 10% by weight.

A preferred class of organic peroxyacid compounds are the amide substituted compounds of the following general formulae:

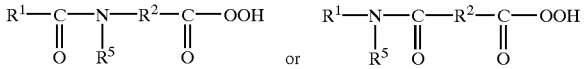

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Where the particulate bleaching component comprises catalyst, suitable catalysts comprise heavy metal cations of defined bleach catalytic activity, such as copper, iron or manganese cations, an auxiliary metal cation having little or no bleach catalytic activity, such as zinc or aluminium cations, and a sequestrant having defined stability constants for the catalytic and auxiliary metal cations, particularly ethylenediaminetetraacetic acid, ethylenediaminetetra (methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5.244,594. Preferred examples include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$. Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C-OH groups. Other examples include binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

Further suitable bleach catalysts are described, for example, in European patent application No. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. No. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

As used herein, the phrase "geometric mean particle diameter" means the geometric mass median diameter of a set of discrete particles as measured by any standard mass-based particle size measurement technique, preferably by dry sieving. A suitable sieving method is in accordance with ISO 3118 (1976). A suitable device is a Ro-Tap testing sieve shaker Model B using 20.3 cm (8 inch) sieves of selected sizes. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook*, pp. 6–11, Marcel Dekker 1997.

The geometric mean particle diameter of the particulate bleach component for use in the bleaching granule of the present invention is below 500 $\mu$m. The inventors have found that using smaller particle size particulate bleach components as a minor ingredient in a granule comprising other detergent ingredients and/or fillers gives surprisingly beneficial fabric damage in addition to highly effective bleaching. In the prior art, efforts have always been made to increase the activity of bleach activator particles as much as possible and the present invention is in contrast to those prior art solutions and gives surprising results. Preferably, the geometric mean particle diameter of the particulate bleach component will be below 400 $\mu$m, or even below 300 $\mu$m, or 200 $\mu$m or below 100 $\mu$m. Preferably, the span of the particulate bleach component will be no greater than 2, preferably no greater than 1.8 or even no greater than 1.7.

The builder and/or surfactant and/or optional detergent ingredients and/or fillers incorporated in the detergent granules of the invention may be mixed with the bleach component(s) as the individual detergent ingredients or may be fully or partially in the form of a pre-formed granule comprising two or more detergent ingredients. In one embodiment of the invention, the detergent granule comprises a mixture of bleach component and pre-formed particle and individual detergent ingredients.

As used herein, the pre-formed particulate may comprise any combination of two or more detergent ingredients. Suitable pre-formed particulates may have been formed by any method suitable for combining a plurality of ingredients, such as by spray-drying, agglomeration, marumerisation, extrusion or compaction processes, all of which methods for combining detergent ingredients are well known in the art. Particularly preferred pre-formed particulates are powders obtained from spray-drying processes, agglomerates and extrudates. Spray dried powders are particularly useful.

Suitable spray-drying processes for forming such pre-formed particulates are described for example in EP-A-763 594 or EP-A-437888. Suitable processes for forming pre-formed particulates which are agglomerates are described for example in WO93/25378, EP-A-367339, EP-A420317 or EP-A-506184 and suitable processes for forming pre-formed particulates by extrusion are described for example in WO91/02047.

The pre-formed particulates may be in their wet or dry states for exarnple, it is common in formation of detergent particulates that initially, the particulates are wet and undergo a drying stage. In the present invention, the pre-formed particulates may be particulates before undergoing a drying stage. Generally this means that a solvent used as a binding agent for the processing is present in higher amounts that are desirably present in a finished particulate detergent. Generally, such a solvent will be water and the particulates may have a water content for example 15 to 30 wt % of the pre-formed particulate. Often however, the pre-formed particulates will already have undergone a drying step prior to addition to the mixer so that the water content may be below 15 wt % or even below 10 wt %. Preferred pre-formed particulates comprise surfactant, preferably in amounts above 5 wt % or even above 10 or 20 wt %.

Where individual detergent ingredients are mixed with the bleach component to form the detergent granule of the invention, any detergent ingredient is suitable. Suitable particulate materials include solid surfactants or soaps, or water soluble or dispersible polymeric materials, enzymes, bleach salts such as peroxy salts, but are generally inorganic components, particularly water soluble inorganic components such as builders. Suitable liquids include surfactant or binders which are liquid under conditions of use or which may be added as a melt or solution in a removable solvent (generally water). These ingredients are discussed in more detail below.

It is particularly preferred that the bleaching granules of the invention comprise a surfactant or mixture of surfactants. Suitable surfactants are described below. The surfactant content of the bleaching granules is preferably from 5 to 80% by weight of the granule. Amounts of surfactants above 10 or even above 30% may be preferred. Amounts of surfactant below 70% or even below 50% may be preferred. Where the bleaching granules comprise surfactant, generally they will in addition, comprise a builder or alkalinity agent such as sodium carbonate, zeolite, or phosphate. For example, each of these components individually, or in mixtures may be present in amounts above 5%, preferably above 10% or even above 20% by weight of the content of the pre-formed particulate component. Particularly preferred builder components are sodium carbonate and/or zeolite. Zeolite A and zeolite MAP are both suitable.

A bleaching granule according to the invention preferably also comprises an organic builder such as a poly carboxylic acid and/or salt such as citric acid, tartaric acid, malic acid, succinic acid and their salts or a polymeric polycarboxylate such as polymers based on acrylic acids or maleic acids or co-polymers thereof Such components are generally present in the particle at levels below 15 wt % of the particulate component, preferably below 10 wt % of the particulate component.

Other preferred ingredients in the bleaching granules of the invention are chelants such as NTA or phosphonate chelants such as DTPA and/or succinic acid derivative chelants, as described below. These components are preferably present in the bleaching granules in amounts below 5 wt % or even below 2 wt % of the first particulate component. Suds suppressors and/or soil release polymers and/or bleach activators are also suitable ingredients which may be incorporated.

The bleaching granules of the invention preferably have a percentage equilibrium relative humidity (%eRH) below 15 wt %, more preferably below 10 wt % or even below 5 wt % %eRH is a measure of free moisture in a granular product and the measurement is carried out in a closed cell in equilibrium with air at a given temperature (25° C.). A sample of detergent granules to be measured are placed in the closed cell and the environment and sample come into equilibrium in the cell over 24 hours and the %eRH is calculated as follows:

$$\%eRH=(\text{measured humidity}/\text{saturated humidity})\times 100$$

where saturated humidity is a constant for a given temperature.

A suitable apparatus for measuring %eRH is a Rotronic WA HYGROLYT probe (model WA-14), a Rotronic DT1 display instrument and a Rotronic sample holder such as EW4–14. Anyone skilled in the art will recognise other compatible equipment may also be used. Analysis is repeated 24 times on samples of each granular product to produce an average %eRH result.

The bleaching granules themselves may contain all of the ingredients of a fully formulated detergent or may be mixed with additional detergent ingredients such as individual detergent ingredients in particulate form or pre-formed detergent particles as described above. Preferably the detergent compositions of the present invention comprise more than 30 wt %, more preferably more than 50 wt % or even as high as 80 or 90 wt % or even at least 95 wt % of the bleaching granules according to the present invention. Generally, the bleaching granules are substantially free of peroxide source persalts such as perborate and percarbonate salts. These detergent ingredients are preferably added as dry added ingredients to the bleaching granules of the invention to form a fully formulated detergent.

In accordance with the process of the present invention, a first feed stream comprising the bleaching component and a second feed stream comprising builder and/or surfactant and optional other detergent ingredients and/or fillers are fed into a high, moderate or low shear mixer in a mixing step to form the bleaching granules.

The processes of the invention may comprise the step of adding to the mixer a binder to facilitate production of the desired bleaching granules. Generally such a binder will be liquid, generally in the form of a solution or melt and will be added either by spraying directly into the mixer or onto the particulate components as they travel into the mixer. In a preferred embodiment of the invention, the binder is added directly into the mixer, for example by spraying. Alternatively, in a particularly preferred embodiment of the invention, the binder may be fed into the mixer through a third feed stream and this will be particularly preferred where the binder is a viscous liquid, and is therefore unsuitable for spraying.

The binder is added for purposes of enhancing agglomeration by providing a binding or sticking agent for detergent ingredients in the bleaching granule. The binder may be any conventional detergent binding agent, preferably selected from the group consisting of water, anionic surfactants, nonionic surfactants, polymers such as polyethylene glycol, polyvinyl pyrrolidone, polyacrylates, and/or organic acids or their salts such as citric acid or citric salts, and mixtures thereof. Other suitable binder materials including those listed herein are described in Beerse et al, U.S. Pat. No. 5,108,646 (Procter and Gamble Company), the disclosure of which is incorporated herein by reference. Particularly preferred binders comprise surfactants, in particular anionic surfactants. Suitable surfactants are described below, however, liquids or pastes comprising alkyl sulfate surfactant, either branched and/or straight chain or alkyl sulphonate surfactants or mixtures thereof, are preferred. Branched alkyl sulfates, optionally in combination with one or more additional anionic and/or nonionic surfactants are particularly preferred. Particularly preferred surfactant pastes comprise at least 15wt % anionic surfactant, more preferably at least 30% or even at least 40wt % active surfactant.

Thus, in one aspect of the invention, a first feed stream of particulate bleach component is fed into the mixer and in addition a second feed stream comprising the surfactant and/or builder and optional additional detergent ingredients and/or fillers is fed into the mixer, and binder is also present in the mixer. The binder may be fed directly via a third stream into the mixer or it may be contacted with the first and/or second particulate component prior to one or both of these feed streams entering the mixer. Where the mixer is divided into different zones, the three components may be fed into the same zone or optionally may be fed into different zones. In a preferred embodiment of the invention, the first and second particulate components will be pre-mixed prior to addition of the binder.

In a further preferred aspect of the invention, after mixing of the particulate bleaching component and a second particulate component comprising surfactant and/or builder and optional additional detergent ingredients and/or fillers, optionally with binder, so that adhesion of the two components has taken place, a further liquid component is applied to the outside of the particles produced. This further coating may be the same chemical composition as the binder or may be any of the other coating materials or detergent ingredients described below.

In order to provide the shear mixing, high, moderate or low shear mixing may be suitable. Suitable high shear mixers include Lodige CB mixers and any mixer providing shear greater than that provided by a KM Lodige with the tip speed of the ploughs greater than 10 m/s or even greater than 12 or 15 m/s. It may however, be preferred to use moderate to low shear mixers. This is preferred for example, where detergent ingredients which are sensitive to heat and shear such as enzymes, perfumes or other encapsulated ingredients are incorporated. Suitable mixers for providing moderate to low shear mixing may be for example a Lodige KM (trademark) (Ploughshare) moderate speed mixer, or mixer made by Fukae, Draes, Schugi or similar brand mixers which mix with only moderate to low shear. The Lodige KM (ploughshare) moderate speed mixer which is a preferred mixer for use in the present invention comprises a horizontal hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. The grinding or pulverizing is accomplished by cutters, generally smaller in size than the rotating shaft, which preferably operate at about 3600 rpm. Other mixers similar in nature which are suitable for use in the process include the Lodige Ploughshare™ mixer and the Drais® K-T 160 mixer. Generally, in the processes of the present invention, the shear will be no greater than the shear produced by a Lodige KM mixer with the tip speed of the ploughs below 10 m/s, or even below 8 m/s or even lower.

Preferably, the mean residence time of the various starting detergent ingredients in the mixer, generally in the low or moderate speed mixer is preferably in range from about 0.1 minutes to about 15 minutes, most preferably the residence time is about 0.5 to about 5 minutes. In this way, the density of the resulting detergent agglomerates is at the desired level.

Other suitable mixers for use in the present invention are low or very low shear mixers such as rotating bowl agglomerators, drum agglomerators, pan agglomerators and fluid bed agglomerators. Fluid bed agglomerators may be preferred. Typical fluidised bed agglomerators are operated at a superficial air velocity of from 0.4 to 4 m/s, either under positive or negative pressure. Inlet air temperatures generally range from −10 or 5° C. up to 250° C. However inlet air temperatures are generally below 200° C, or even below 150° C. The fluidized bed granulator is preferably operated such that the flux number FN of the fluid bed is at least about 2.5 to about 4.5. Flux number ($FN_m$) is a ratio of the excess velocity ($U_e$) of the fluidisation gas and the particle density ($p_p$) relative to the mass flux ($q_{liq}$) of the liquid sprayed into the bed at a normalized distance ($D_o$) of the spraying device. The flux number provides an estimation of the operating parameters of a fluidized bed to control granulation within the bed. The flux number is expressed by the formula:

$$FN_m = \log_{10}[\{P_p U_e\}/q_{liq}]$$

and the calculation of the flux number and a description of its usefulness is fully described in WO 98/58046 the disclosure of which is herein incorporated by reference.

In addition, the fluidized bed is generally operated at a Stokes number of less than about 1, more preferably from about 0.1 to about 0.5. The Stokes number is a measure of particle coalescence for describing the degree of mixing occurring to particles in a piece of equipment such as the fluid bed. The Stokes number is measured by the formula:

$$\text{Stokes number} = 4pvd/9u$$

wherein p is the apparent particle density, v is the excess velocity, d is the mean particle diameter and u is the viscosity of the binder. The Stokes number and a description of its usefulness is described in detail in WO 99/03964, the disclosure of which is herein incorporated by reference.

Thus, where the mixer is a fluid bed mixer, the particulate bleaching component and a second particulate component comprising the additional ingredients are passed into a fluid bed optionally having multiple internal "stages" or "zones". A stage or zone is any discrete area within the fluid bed, and these terms are used interchangeably herein. The process conditions within a stage may be different or similar to the other stages in the fluid bed/dryer. It is understood that two adjacent fluid beds are equivalent to a single fluid bed having multiple stages. The various feed streams of the particulate bleaching component and fuirher particulate components can be added at the same or different stages, depending on, for example, the particle size and moisture level of the feed stream. Feeding different streams to different stages can minimize the heat load on the fluid bed, and optimize the particle size and increase uniformity of the shape of the detergent particles produced.

The bed is typically fluidized with heated air in order to dry or partially dry moisture such as any binder liquids from the ingredients in the fluid bed. Where binder is sprayed into the fluid bed the spraying is generally achieved via nozzles capable of delivering a fine or atomized spray of the binder to achieve intimate mixing with the particulates. Typically, the droplet size from the atomizer is less than about 100 μm. This atomization can be achieved either through a conventional two-fluid nozzle with atomizing air, or alternatively by means of a conventional pressure nozzle. To achieve this type of atomization, the solution or slurry rheology is may have a viscosity of less than about 500 centipoise, preferably less than about 200 centipoise. While the nozzle location in the fluid bed may be in most any location, the preferred location is a positioning that allows a vertical down spray of any liquid components such as binder. This may be achieved for example, using a top spray configuration. To achieve best results, the nozzle location is placed at or above the fluidized height of the particles in the fluid bed. The fluidized height is typically determined by a weir or overflow gate height. The agglomeration/granulation zone of the fluid bed may be followed by an optional coating zone, followed by a drying zone and a cooling zone. Of course, one of ordinary skill in the art will recognize that alternative arrangements are also possible to achieve the resultant particles of the present invention.

Typical conditions within a fluid bed apparatus of the present invention include: (i) a mean residence time from about 1 to about 20 minutes, (ii) a depth of unfluidised bed of from about 100 to about 600 mm, (iii) a droplet spray size of less than 2 times the mean particle size in the bed, which is preferably not more than about 50 micron, (iv) spray height generally from 150 to 1600 mm of spray height from the fluid bed plate or preferably 0 to 600 mm from the top of the fluid bed, (v) from about 0.4 to about 4.0 m/s, preferably 1.0 to 3.0 m/s of fluidizing velocity and (vi) from about 12 to about 200° C. of bed temperature, preferably 15 to 100° C. Once again, one of ordinary skill in the art will recognize that the conditions in the fluid bed may vary depending on a number of factors.

The bleaching granules produced in the mixer can be further processed by adding a coating agent to improve the particle colour, increase the particle whiteness or improve the particle flowability after the detergent particles exit the mixer or the dryer if an optional drying step is added subsequently to the mixer or in a later stage in the mixer, to obtain the high density granular detergent compositions produced by the processes of the invention. Those skilled in the art will appreciate that a wide variety of methods may be used to dry as well as cool the exiting detergent without departing from the scope of the invention. Since the mixer can be operated at relatively low temperatures, the need for cooling apparatus is generally not required in the present process which thereby further reduces manufacturing costs of the final product.

Another optional processing step includes continuously adding a coating agent such as zeolite and/or fumed silica to the mixer to facilitate free flowability of the resulting detergent particles and to prevent over agglomeration. Such coating agents generally have a mean particle size below 100 microns, preferably below 60 microns, even more preferably below 50 microns.

Any coating stage may take place either immediately after formation of the bleaching granules of the invention either before or after any drying step and/or optionally after the bleaching granules have been mixed with any additional detergent ingredients for forming a fully formulated detergent composition. Preferably any such coating agent will also have active properties useful in a detergent composition. One preferred coating agent is a surfactant or aqueous solution of surfactant.

Detergent ingredients which are suitable as ingredients of the bleaching granule or as any additional ingredients added to the bleaching granules of the present invention to form the fully formulated detergent compositions of the invention, are described below.

DETERGENT INGREDIENTS

Surfactant

Suitable surfactants for use in the invention are anionic, nonionic, ampholytic, and zwitterionic classes of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Preferably, the detergent granules of the present invention and compositions comprising such granules comprise an anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

The anionic surfactants may be present in the detergent granule in amounts below 25 wt % or even below 20 wt % but in a final detergent composition comprising the particle, is preferably present at a level of from 0.1% to 60%, more preferably from 1 to 40%, most preferably from 5% to 30% by weight.

Other anionic surfactants include the anionic carboxylate surfactants such as alkyl ethoxy carboxylates, alkyl polyethoxy polycarboxylates and soaps ("alkyl carboxyls") such as water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors. Other suitable anionic surfactants are the alkali metal sarcosinates of formula R—CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Other anionic surfactants include isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl—N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein). Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates. Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

Preferred surfactant combinations are mixtures of the preferred alkyl sulfate and/or sulfonate and alkyl ethoxysulfate surfactants optionally with cationic surfactant. Such mixtures have been disclosed in PCT Patent Application No. WO 93/18124.

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Essentially any alkoxylated nonionic surfactant or mixture is suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are particularly suitable for use herein. Particularly preferred are the condensation products of straight or branched, primary or secondary alcohols having an alkyl group containing from 6 to 22 carbon atoms with from 2 to 10 moles of ethylene oxide per mole of alcohol.

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable $C_1$–C4 alkyl; and $R_2$ is a $C_5$–$C_{31}$ hydrocarbyl; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units. Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Suitable amphoteric surfactants for use herein include the amnine oxide surfactants and the alkyl amphocarboxylic acids. Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaines such as $C_{12-18}$ dimethyl-ammonio hexanoate and the $C_{10-18}$ acylamidopropane (or ethane) dimethyl (or diethyl) betaines and sultaine surfactants are exemplary zwitterionic surfactants for use herein.

Suitable cationic surfactants to be used herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Cationic ester surfactants such as choline ester surfactants, have for example been disclosed in U.S. Pat. Nos. 4228042, 4239660 and 4260529 are also suitable as are cationic mono-alkoxylated amine surfactants preferably of the general formula I:

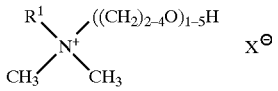

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

The levels of the cationic mono-alkoxylated amine surfactants in the detergent compositions of the invention are generally from 0.1% to 20%, preferably from 0.2% to 7%, most preferably from 0.3% to 3.0% by weight.

Cationic bis-alkoxylated amine surfactant such as

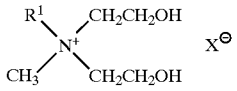

are also useful, wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride.

Bleach Activator

The detergent compositions of the invention may comprise bleach activator in addition to any bleach activator present in the bleaching granules. Generally these will be dry added as particulate raw materials to the bleaching granules of the invention. Suitable bleach activators, catalysts and/or pre-formed peracids are as described above. However, in order to benefit fully from the invention, preferably at least the bleach activator and most preferably also any catalyst and pre-formed peracid is incorporated into a finished detergent composition as part of the claimed bleaching granules.

Peroxide Source

Inorganic perhydrate salts are a preferred source of peroxide. Preferably these salts are present at a level of from 0.01% to 50% by weight, more preferably of from 0.5% to 30% by weight of the composition or component.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

Chelants

As used herein, chelants refers to detergent ingredients which act to sequester (chelate) heavy metal ions. These components may also have calcium and magnesium chelation capacity, but preferentially they show selectivity to binding heavy metal ions such as iron, manganese and copper.

Chelants are generally present in the detergent particle or final detergent composition at a level of from 0.005% to 10%, preferably from 0.1% to 5%, more preferably from 0.25% to 7.5% and most preferably from 0.3% to 2% by weight of the compositions or component.

Suitable chelants include organic phosphonates, such as the amino alkylene poly (alkylene phosphonates), alkali metal ethane 1-hydroxy disphosphonates and nitrilo trimethylene phosphonates, preferably, diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable chelants for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof, and iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic acid N-carboxyrnethyl N-2-hydroxypropyl-3-sulfonic acid sequestrants described in EP-A-516,102 are also suitable herein. The β-alanine-N,N'-diacetic acid, aspartic acid-N, N'-diacetic acid, aspartic acid-N-monoacetic acid and iminodisuccinic acid sequestrants described in EP-A-509,382 are also suitable. EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable. Especially preferred are diethylenetriarnine pentacetic acid, ethylenediamine-N,N'-disuccinic acid (EDDS) and 1,1, hydroxyethane diphosphonic acid or the alkali metal, alkaline earth metal, ammonium, or substituted ammonium salts thereof, or mixtures thereof. In particular the chelating agents comprising a amino or amine group can be bleach-sensitive and are suitable in the compositions of the invention.

Water-Soluble Builder Compound

The granules or compositions herein preferably contain a water-soluble builder compound, typically present in detergent compositions at a level of from 1% to 80% by weight, preferably from 10% to 60% by weight, most preferably from 15% to 40% by weight.

The detergent compositions of the invention preferably comprise phosphate-containing builder material. Preferably present at a level of from 0.5% to 60%, more preferably from 5% to 50%, more preferably from 8% to 40%.

The phosphate-containing builder material preferably comprises tetrasodium pyrophosphate or even more preferably anhydrous sodium tripolyphosphate.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

Borate builders, as well as builders containing borate-forming materials that can produce borate under detergent storage or wash conditions are useful water-soluble builders herein.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Partially Soluble or Insoluble Builder Compound

The granules in accord with the present invention or the compositions herein may contain a partially soluble or insoluble builder compound, typically present in detergent compositions at a level of from 0.5% to 60% by weight, preferably from 5% to 50% by weight, most preferably from 8% to 40% weight.

Examples of largely water insoluble builders include the sodium aluminosilicates. As mentioned above, it may be preferred in one embodiment of the invention, that only small amounts of alumino silicate builder are present.

Suitable aluminosilicate zeolites have the unit cell formula $Na_z[(AlO2)_z(SiO_2)_y]$. $xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof Zeolite A has the formula:

$$Na_{12}[AlO_2)_{12}(SiO_2)_{12}].xH_2O$$

wherein x is from 20 to 30, especially 27. Zeolite X has the formula $Na_{86}$ $[(AlO_2)_{86}(SiO_2)_{106}]$.276 $H_2O$.

Another preferred aluminosilicate zeolite is zeolite MAP builder. The zeolite MAP can be present at a level of from 1% to 80%, more preferably from 15% to 40% by weight. Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2. Of particular interest is zeolite MAP having a silicon to aluminium ratio not greater than 1.15 and, more particularly, not greater than 1.07. In a preferred aspect the zeolite MAP detergent builder has a particle size, expressed as a median particle size $d_{50}$ value of from 1.0 to 10.0 micrometres, more preferably from 2.0 to 7.0 micrometres, most preferably from 2.5 to 5.0 micrometres. The $d_{50}$ value indicates that 50% by weight of the particles have a diameter smaller than that figure. The particle size may, in particular be determined by conventional analytical techniques such as microscopic determination using a scanning electron microscope or by means of a laser granulometer, described herein. Other methods of establishing $d_{50}$ values are disclosed in EP 384070A.

Other Detergent Ingredients

A preferred ingredients of the compositions herein are dyes and dyed particles or speckles, which can be bleach-sensitive. The dye as used herein can be a dye stuff or an aqueous or nonaqueous solution of a dye stuff. It may be preferred that the dye is an aqueous solution comprising a dyestuff, at any level to obtain suitable dyeing of the detergent particles or speckles, preferably such that levels of dye solution are obtained up to 2% by weight of the dyed particle, or more preferably up to 0.5% by weight, as described above. The dye may also be mixed with a non-aqueous carrier material, such as non-aquous liquid materials including nonionic surfactants.

Optionally, the dye also comprising other ingredients such as organic binder materials, which may also be a non-aqueous liquid.

The dyestuff can be any suitable dyestuff. Specific examples of suitable dyestuffs include E104—food yellow 13 (quinoline yellow), E110 —food yellow 3 (sunset yellow FCF), E131—food blue 5 (patent blue V), Ultra Marine blue (trade name), E133—food blue 2 (brilliant blue FCF), E140—natural green 3 (chlorophyll and chlorphyllins), E141 and Pigment green 7 (chlorinated Cu phthalocyanine). Preferred dyestuffs may be Monastral Blue BV paste (trade name) and/or Pigmasol Green (trade name).

Another preferred ingredient of the particles or compositions of the invention is a perfume or perfume composition. Any perfune composition can be used herein. The perfumes may also be encapsulated. Preferred perfumes containing at least one component with a low molecular weight volatile component, e.g. having a molecular weight of from 150 to 450 or preferably 350. Preferably, the perfume component comprises an oxygen-containing functional group. Preferred functional groups are aldehyde, ketone, alcohol or ether functional groups or mixtures thereof.

Another highly preferred ingredient useful in the particles or compositions herein is one or more additional enzymes. Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. No. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amnylase enzymes maybe those described in PCT/U.S. Pat. No. 9,703,635, and in WO95/26397 and WO96/23873. Amylase enzyme may be incorporated into the composition in accordance with the invention at a level of from 0.0001% to 2% active enzyme by weight. Lipolytic enzyme may be present at levels of active lipolytic enzyme of from 0.0001% to 2% by weight, preferably 0.001% to 1% by weight, most preferably from 0.001% to 0.5% by weight. The lipase may be fungal or bacterial in origin being obtained, for example, from a lipase producing strain of Humicola sp., Thermomyces sp. or Pseudomonas sp. including *Pseudomonas pseudoalcalipenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuzinosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

The component or compositions herein also preferably contain from about 0.005% to 5% by weight of certain types of hydrophilic optical brighteners, as mentioned above.

Examples are Tinopal-UNPA-GX™ and Tinopal-CBS-X™ by Ciba-Geigy Corporation. Others include Tinopal 5BM-GX™, Tinopal-DMS-X™ and Tinopal AMS-GX™ by Ciba Geigy Corporation.

Photo-Bleaching Agent

Photo-bleaching agents are preferred ingredients of the compositions or components herein. Preferred photo-bleaching agent herein comprise a compounds having a porphin or porphyrin structure. Porphin and porphyrin, in the literature, are used as synonyms, but conventionally porphin stands for the simplest porphyrin without any substituents; wherein porphyrin is a sub-class of porphin. The references to porphin in this application will include porphyrin. The porphin structures preferably comprise a metal element or cation, preferably Ca, Mg, P, Ti, Cr, Zr, In, Sn or Hf, more preferably Ge, Si or Ga, or more preferably Al , most preferably Zn.

It can be preferred that the photo-bleaching compound or component is substituted with substituents selected from alkyl groups such as methyl, ethyl, propyl, t-butyl group and aromatic ring systems such as pyridyl, pyridyl-N-oxide, phenyl, naphthyl and anthracyl moieties.

The photo-bleaching compound or component can have solubilizing groups as substituents. Alternatively, or in addition hereto the photo-bleaching agent can comprise a polymeric component capable of solubilizing the photo-bleaching compound, for example PVP, PVNP, PVI or co-polymers thereof or mixtures thereof. Highly preferred photo-bleaching compounds are compounds having a phthalocyanine structure, which preferably have the metal elements or cations described above. The phthalocyanines can be substituted for example the phthalocyanine structures which are substituted at one or more of the 1–4, 6, 8–11, 13, 15–18, 20, 22–25, 27 atom positions.

Organic Polymeric Ingredients

Organic polymeric compounds are preferred additional herein and are preferably present as components of any particulate components where they may act such as to bind the particulate component together. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions or component.

Terpolymers containing monomer units selected from maleic acid, acrylic acid, polyaspartic acid and vinyl alcohol, particularly those having an average molecular weight of from 5,000 to 10,000, are also suitable herein. Other organic polymeric compounds suitable for incorporation in the detergent compositions herein include cellulose derivatives such as methylcellulose, carboxymethylcellulose, hydroxypropylmethylcellulose and hydroxyethylcellulose. Further useful organic polymeric compounds are the polyethylene glycols, particularly those of molecular weight 1000–10000, more particularly 2000 to 8000 and most preferably about 4000. Highly preferred polymeric components herein are cotton and non-cotton soil release polymer according to U.S. Pat. No. 4,968,451, Scheibel et al., and U.S. Pat. No. 5,415,807, Gosselink et al., and in particular according to U.S. application Ser. No. 60/05 1517.

Another organic compound, which is a preferred clay dispersant/anti-redeposition agent, for use herein, can be the ethoxylated cationic monoamines and diamines of the formula:

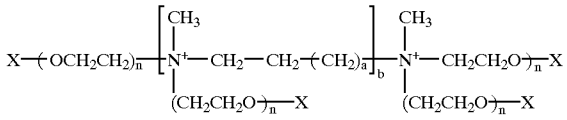

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No. 4,664,848.

Suds Suppressing System

The granules and detergent compositions herein, when formulated for use in machine washing compositions, may comprise a suds suppressing system present at a level of from 0.01% to 15%, preferably from 0.02% to 10%, most preferably from 0.05% to 3% by weight of the composition or component. Suitable suds suppressing systems for use herein may comprise essentially any known antifoam compound, including, for example silicone antifoam compounds and 2-alkyl alcanol antifoam compounds or soap. By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof as described in U.S. Pat. No. 2,954,347, issued Sep. 27, 1960 to Wayne St. John. Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkalimetal (e.g. sodium, potassium, lithium) phosphates and phosphate esters.

A preferred suds suppressing system comprises antifoam compound, preferably comprising in combination polydimethyl siloxane, at a level of from 50% to 99%, preferably 75% to 95% by weight of the silicone antifoam compound; and silica, at a level of from 1% to 50%, preferably 5% to 25% by weight of the silicone/silica antifoam compound wherein said silica/silicone antifoam compound is incorporated at a level of from 5% to 50%, preferably 10% to 40% by weight a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10% such as DCO544, commercially available from DOW Coming, and an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight.

A highly preferred particulate suds suppressing system is described in EP-A-0210731. EP-A-0210721 discloses other preferred particulate suds suppressing systems.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric dye transfer inhibiting agents when present are generally in amounts from 0.01% to 10%, preferably from 0.05% to 0.5% and are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Polymeric soil release agents, hereinafter "SRA", can optionally be employed in the present components or compositions. If utilized, SRAs will generally be used in amounts from 0.01% to 10.0%, typically from 0.1% to 5%, preferably from 0.2% to 3.0% by weight. Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures. Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRAs are for example as described in U.S. Pat. No. 4,968,451, Nov. 6, 1990 to J. J. Scheibel and E. P. Gosselink. Other SRAs include the nonionic end-capped 1,2-propylene/polyoxyethylene terephthalate polyesters of U.S. Pat. No. 4,711,730, Dec. 8, 1987 to Gosselink et al. Other examples of SRA's include: the partly- and fully-anionic-end-capped oligomeric esters of U.S. Pat. No. 4,721,580, Jan. 26, 1988 to Gosselink; the nonionic-capped block polyester oligomeric compounds of U.S. Pat. No. 4,702,857, Oct. 27, 1987 to Gosselink; and the anionic, especially sulfoaroyl, end-capped terephthalate esters of U.S. Pat No. 4,877,896, Oct. 31, 1989 to Maldonado, Gosselink et al. SRAs also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Additional classes of SRAs include those described in U.S. Pat. No. 4,201,824, Violland et al. and U.S. Pat. No. 4,240,918 Lagasse et al.; U.S. Pat. No. 4,525,524 Tung et al., and U.S. Pat. No. 4,201,824, Violland et al.

Other optional ingredients suitable for inclusion in the compositions of the invention include colours and filler salts, with sodium sulfate being a preferred filler salt.

Highly preferred compositions contain from about 2% to about 10% by weight of an organic acid, preferably citric acid. Also, preferably combined with a carbonate salt, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

The detergent compositions can include as an additional component a chlorine-based bleach. However, since the detergent compositions of the invention are solid, most liquid chlorine-based bleaching will not be suitable for these detergent compositions and only granular or powder chlorine-based bleaches will be suitable. Alternatively, a chlorine based bleach can be added to the detergent composition by the user at the beginning or during the washing process. The chlorine-based bleach is such that a hypochlorite species is formed in aqueous solution. The hypochlorite ion is chemically represented by the formula OCI.

Those bleaching agents which yield a hypochlorite species in aqueous solution include alkali metal and alkaline earth metal hypochlorites, hypochlorite addition products, chloramines, chlorimines, chloramides, and chlorimides. Specific examples include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin, N-chlorosulfamide, Chloramine T, Dichloramine T, chloramine B and Dichloramine B. A preferred bleaching agent for use in the compositions of the instant invention is sodium hypochlorite, potassium hypochlorite, or a mixture thereof. A preferred chlorine-based bleach can be Triclosan (trade name).

Most of the above-described hypochlorite-yielding bleaching agents are available in solid or concentrated form and are dissolved in water during preparation of the compositions of the instant invention. Some of the above materials are available as aqueous solutions.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 litres, as are typical product dosages and wash solution volumes commonly employed in conventional machine laundry methods. Preferred washing machines may be the so-called low-fill machines.

In a preferred use aspect the composition is formulated such that it is suitable for hard-surface cleaning or hand washing. In another preferred aspect the detergent composition is a pre-treatment or soaking composition, to be used to pre-treat or soak soiled and stained fabrics.

EXAMPLES

The following examples are presented for illustrative purposes only and are not to be construed as limiting the scope of the appended claims in any way.

Abbreviations used in the Examples

In the detergent compositions, the abbreviated component identifications have the following meanings:

LAS: Sodium linear C11–13 alkyl benzene sulfonate
TAS: Sodium tallow alkyl sulfate
CxyAS: Sodium C1x–C1y alkyl sulfate
Branched AS: branched sodium alkyl sulfate as described in W099/19454
C46SAS: Sodium C14–C16 secondary (2,3) alkyl sulfate
CxyEzS: Sodium C1x–C1y alkyl sulfate condensed with z moles of ethylene oxide
CxyEz: C1x–C1y predominantly linear primary alcohol condensed with an average of z moles of ethylene oxide
QAS: R2. N+(CH3)2(C2H4OH) with R2=C12–C14
QAS 1: R2.N+(CH3)2(C2H4OH) with R2=C8–C11
APA: C8–C10 amido propyl dimethyl amine
Soap: Sodium linear alkyl carboxylate derived from an 80/20 mixture of tallow and coconut fatty acids
STS: Sodium toluene sulphonate
CFAA: C12–C14 (coco) alkyl N-methyl glucamide
TFAA: C16–C18 alkyl N-methyl glucamide
TPKFA: C12–C14 topped whole cut fatty acids
STPP: Anhydrous sodium tripolyphosphate
TSPP: Tetrasodium pyrophosphate
Zeolite A: Hydrated sodium aluminosilicate of formula Na12(AlO2SiO2)12.27H2O having a primary particle size in the range from 0.1 to 10 micrometers (weight expressed on an anhydrous basis)
NaSKS-6: Crystalline layered silicate of formula d-Na2Si2O5

Citric acid: Anhydrous citric acid
Borate: Sodium borate
Carbonate: Anydrous sodium carbonate: particle size 200 μm to 900 μm
Bicarbonate: Anhydrous sodium bicarbonate with a particle size distribution between 400 μm and 1200 μm
Silicate: Amorphous sodium silicate (SiO2:Na2O=2.0:1)
Sulfate: Anhydrous sodium sulfate
Mg sulfate: Anhydrous magnesium sulfate
Citrate: Tri-sodium citrate dihydrate of activity 86.4% with a particle size distribution between 425 μm and 850 μm
MA/AA: Copolymer of 1:4 maleic/acrylic acid, average m. wt. about 70,000
MA/AA (1): Copolymer of 4:6 maleic/acrylic acid, average m. wt. about 10,000
AA: Sodium polyacrylate polymer of average molecular weight 4,500
CMC: Sodium carboxymethyl cellulose
Cellulose ether: Methyl cellulose ether with a degree of polymerization of 650 available from Shin Etsu Chemicals
Protease: Proteolytic enzyme, having 3.3% by weight of active enzyme, sold by NOVO Industries A/S under the tradename Savinase
Protease I: Proteolytic enzyme, having 4% by weight of active enzyme, as described in WO 95/10591, sold by Genencor Int. Inc.
Alcalase: Proteolytic enzyme, having 5.3% by weight of active enzyme, sold by NOVO Industries A/S
Cellulase: Cellulytic enzyme, having 0.23% by weight of active enzyme, sold by NOVO Industries A/S under the tradename Carezyme
Amylase: Amylolytic enzyme, having 1.6% by weight of active enzyme, sold by NOVO Industries A/S under the tradename Termamyl 120T
Lipase: Lipolytic enzyme, having 2.0% by weight of active enzyme, sold by NOVO Industries A/S under the tradename Lipolase
Lipase (1): Lipolytic enzyme, having 2.0% by weight of active enzyme, sold by NOVO Industries A/S under the tradename Lipolase Ultra
Endolase: Endoglucanase enzyme, having 1.5% by weight of active enzyme, sold by NOVO Industries A/S
PB4: Sodium perborate tetrahydrate of nominal formula NaB02.3H2 O.H2O2—
PB1: Anhydrous sodium perborate bleach of nominal formula NaBO2.H 2O2
Percarbonate: Sodium percarbonate of nominal formula 2Na2CO3.3H2O2
NOBS: Nonanoyloxybenzene sulfonate in the form of the sodium salt
NACA-OBS: (6-nonamidocaproyl) oxybenzene sulfonate
TAED: Tetraacetylethylenediamine
DTPA: Diethylene triamine pentaacetic acid
DTPMP: Diethylene triamine penta (methylene phosphonate), marketed by Monsanto under the Tradename Dequest 2060
EDDS: Ethylenediamine-N,N'-disuccinic acid, (S,S) isomer sodium salt.
Photoactivated bleach: Sulfonated zinc phthlocyanine encapsulated in bleach (1) dextrin soluble polymer
Photoactivated bleach: Sulfonated alumino phthlocyanine encapsulated in bleach (2) dextrin soluble polymer
Brightener 1: Disodium 4,4'-bis(2-sulphostyryl)biphenyl
Brightener 2: Disodium 4,4'-bis(4-anilino-6-morpholino-1,3,5-triazin-2-yl)amino) stilbene-2:2'-disulfonate
HEDP: 1,1-hydroxyethane diphosphonic acid
PEGx: Polyethylene glycol, with a molecular weight of x (typically 4,000)
PEO: Polyethylene oxide, with an average molecular weight of 50,000
TEPAE: Tetraethylenepentaamine ethoxylate
PVI: Polyvinyl imidosole, with an average molecular weight of 20,000
PVP: Polyvinylpyrolidone polymer, with an average m. wt. of 60,000
PVNO: Polyvinylpyridine N-oxide polymer, with an av. m. wt. of 50,000
PVPVI: Copolymer of polyvinylpyrolidone and vinylimidazole, with an average molecular weight of 20,000
QEA: bis((C2H5O)(C2H4O)n)(CH3)—N+—C6H12—N+—(CH3) bis((C2H5O)—(C2H4O))n, wherein n=from 20 to 30
SRP 1: Anionically end capped poly esters
SRP 2: Diethoxylated poly (1,2 propylene terephthalate) short block polymer
PEI: Polyethyleneimine with an average molecular weight of 1800 and an average ethoxylation degree of 7 ethyleneoxy residues per nitrogen
Silicone antifoam: Polydimethylsiloxane foam controller with siloxane-oxyalkylene copolymer as dispersing agent with a ratio of said foam controller to said dispersing agent of 10:1 to 100:1
Opacifier: Water based monostyrene latex mixture, sold by BASF Aktiengesellschaft under the tradename Lytron 621
Wax: Paraffin wax
HMEO: Hexamethylenediamine tetra(ethylene oxide)24

Example I

This Example illustrates a process according to this invention which produces free flowing, good dispensing and dissolving bleaching granules and detergent compositions containing them. A premix of dry detergent materials is prepared in a vertical orbital screw mixer. This premix is collected and 10 kg transferred to a batch Lodige FM moderate shear mixer. A binder is prepared by agitating 50% branched AS paste as an aqueous solution at 50° C. The binder is poured onto the powder being blended within the mixer. The shaft speed is 100 rpm and the cutter 3000 rpm. The mixture is allowed to agglomerate for 5 minutes.

Agglomerated premix is fed to a fluid bed drier with inlet air at 120° C. and allowed to dry for 8 minutes. The product is collected and screened between 355 μm and 1000 μm screens using a continuous vibratory sieve shaker. Fines and oversize are collected. Oversize are ground using a grinder and recycled, along with the fines, back to the process. An optional coating may be added, where an aqueous solution of Burkeite salt (2 Na2SO4.Na2CO3) is sprayed onto the product within a very low shear rotating drum mixer using an air atomised nozzle. Following this step, further fluid bed drying is carried out to reduce the moisture content down to about 8% eRH (in a Mettler infra-red oven).

The full finished detergent composition is then formed by dry mixing other detergent active ingredients (such as enzymes, dyed sodium carbonate speckles, perfume encapsulates) product within a very low shear rotating drum mixer. Liquid additives (e.g. perfume) may also be sprayed on at this stage. The finished product has a bulk density of approximately 800 g/l, and a mean particle size of 600 μm.

| Component | % Weight of full finished detergent composition |
|---|---|
| Dry materials added to the premix | |
| 1. Spray dried granules comprised of | 20.0% |
| LAS | 3.0% |
| Sodium carbonate | 3.0% |
| Soap | 1.5% |
| QAS | 1.0% |
| MA:AA | 0.7% |
| HMEO | 0.8% |
| EDDS,HEDP and/or DTPA | 0.7% |
| Magnesium sulphate | 0.6% |
| Zeolite A | 10.0% |
| 2. Other detergent additives | |
| Surfactant agglomerate (comprising surfactant, zeolite, Na2CO3) | 22.0% |
| SKS-6 powder | 5.0% |
| TAED powder | 3.0% |
| SRP 1 | 0.5% |
| Silicone antifoam particle | 3.0% |
| Sodium carbonate | 3.0% |
| Binder | |
| Branched AS (solids) (delivered as a 50% aqueous solution) | 3.0% |
| Optional coating | |
| Burkeite solids (delivered as a 30% aqueous solution) | 5.0% |
| Brightener | 0.1% |
| Other detergent additives dry-mixed to form final detergent | |
| Sodium percarbonate | 16.0% |
| Photobleach | 0.03% |
| Citric acid | 6.0% |
| NACAOBS | 3.5% |
| Dyed carbonate speckle | 1.0% |
| Perfume encapsulates | 1.0% |
| Enzymes | 1.3% |
| Liquid spray-on | |
| Perfume | 0.4% |
| Zeolite with particie size below 60 $\mu$m | Balance (to 100%) |

Example II

This Example also illustrates the process of the invention and incorporates the parameters of Example I. A premix of dry detergent materials is prepared as in example 1, of composition as listed below. The mix is fed into a continuous Lodige KM 600 plough-share mixer, which is a horizontally-positioned moderate speed mixer, at 200 kg/hr feedrate. The rotational speed of the shaft in the mixer is about 100 rpm and the rotational speed of the cutters is about 3000 rpm. Water, at 60° C., is pumped from a hot water jacketed tank, as binder at 20 kg/hr. The water is atomised using air atomised nozzles positioned within the Lodige KM.

Product from the Lodige KM is fed continuously into a horizontal plate fluidised bed drier, which reduces the free moisture content down to about 5% eRH (Mettler infra-red oven method). Product is collected from the fluid bed and is screened on Mogensen vibratory screening units using three decks with 180 $\mu$m, 710 $\mu$m and 500 $\mu$m screens installed. Oversize particles are ground and recycled to the fluid bed with the fines stream. Collected product (yield between the 1180 $\mu$m and 500 $\mu$m screens) is of density 620 g/L and mean particle size 610 $\mu$m. Other standard detergent materials are then post dry-added to the product in a mixing drum—including enzymes, perfume and dyed carbonate speckles. Spray -on materials such as perfume or nonionic surfactant may also be added at this stage to form a finished detergent product.

| Component | % Weight of full finished detergent composition |
|---|---|
| Dry materials added to the premix | |
| 1. Spray dried granules | 50.0% |
| LAS | 5.0% |
| Branched AS | 3.0% |
| Sodium carbonate | 7.0% |
| Sodium sulphate | 2.0% |
| Soap | 1.5% |
| Brightener | 0.05% |
| QAS | 0.5% |
| MA:AA | 1.5% |
| HMEO | 0.5% |
| EDDS, HEDP and/or DTPA | 0.6% |
| Magnesium sulphate | 0.4% |
| Zeolite A | balance |
| 2. Other detergent additives | |
| SKS-6 powder | 3.5% |
| TAED agglomerate | 2.5% |
| Silicone antifoam particle | 2.5% |
| Sodium carbonate | 8.0% |
| Binder | |
| Water (subsequently removed by drying) | 10.0% |
| Optional coating | |
| Burkeite (solids) (delivered as a 30% aqueous solution) | 5.0% |
| Brightener 15 | 0.1% |
| Other detergent additives dry-mixed to form final detergent | |
| Sodium percarbonate | 10.0% |
| Photobleach | 0.02% |
| Citric acid | 4.0% |
| NACAOBS | 2.5% |
| Dyed carbonate speckle | 1.0% |
| Perfume encapsulates | 0.5% |
| Enzymes | 1.5% |
| Liquid spray-on | |
| Perfume | 0.2% |
| Zeolite | Balance |

TABLE

The following compositions are in accordance with the invention.

| | A | B | C | D | E | F | G | H | Geometric mean Particle diameter (μm) |
|---|---|---|---|---|---|---|---|---|---|
| 1. Spray-dried Granules | | | | | | | | | |
| LAS | 4.0 | 5.0 | 11.0 | 7.0 | 4.0 | 5.0 | 3.0 | 6.0 | 450 μm |
| TAS | — | — | — | — | — | 1.0 | — | — | |
| $C_{45}$AS | 1.0 | — | — | — | 1.0 | — | — | — | |
| C16–C17 branched AS | 2.0 | 3.0 | — | — | 2.0 | — | — | — | |
| DTPA, HEDP and/or EDDS | 0.5 | 0.6 | 0.5 | 0.7 | 1.0 | 0.5 | 0.7 | 0.5 | |
| MgSO4 | 0.5 | 0.4 | 0.5 | 0.4 | 0.5 | 0.5 | 0.6 | 0.5 | |
| Sodium carbonate | 10.0 | 7.0 | 8.0 | 8.0 | 3.0 | 10.0 | 3.0 | 9.0 | |
| Sodium sulphate | 5.0 | 2.0 | 2.0 | 5.0 | 3.0 | 3.0 | — | — | |
| Zeolite A | 18.0 | 20.0 | 18.0 | 10.0 | 20.0 | 17.0 | 10.0 | 15.0 | |
| SKS-6 | — | — | — | — | — | — | — | — | |
| MA/AA or AA | 1.0 | 1.5 | 1.0 | 0.6 | 1.0 | 0.6 | 0.7 | 0.7 | |
| QAS 1 | 1.0 | 0.5 | 1.0 | — | 0.8 | 1.0 | 1.0 | 1.2 | |
| Brightener | 0.1 | 0.05 | 0.05 | 0.06 | 0.05 | 0.05 | — | — | |
| HMEO | 0.5 | 0.5 | 1.0 | 0.5 | 1.0 | 1.0 | 0.8 | 1.0 | |
| Soap | — | 1.5 | 1.0 | 1.5 | — | 1.5 | 1.5 | 1.5 | |
| 2. Components within the premix | | | | | | | | | |
| Spray dried granules (1) | 50.0 | 50.0 | 48.0 | 40.0 | 40.0 | 50.0 | 20.0 | 40.0 | |
| Nonionic AE7/AE5 | — | — | 5.0 | — | — | — | — | — | |
| Sodium carbonate | 2.0 | 8.0 | — | 4.0 | 6.0 | 5.0 | 3.0 | 2.0 | 200 μm |
| Sodium sulphate | — | — | — | — | 2.0 | 1.0 | — | — | 350 μm |
| QAS 1 agglomerate | — | — | — | 2.0 | — | 1.0 | — | — | 500 μm |
| Nonionic agglomerate | — | — | — | 10.0 | — | — | — | — | 500 μm |
| SKS-6/LAS agglomerate | — | — | — | 12.0 | — | — | — | — | 350 μm |
| Surfactant agglomerate (AS, branched AS, zeolite, sodium carbonate) | — | — | — | — | — | — | 22.0 | — | 600 μm |
| Silicone antifoam agglomerate | 2.5 | 2.5 | 2.0 | 0.5 | — | 2.5 | 3.0 | 2.0 | 500 μm |
| SRP 1 | 0.5 | — | — | — | 0.5 | 0.3 | 0.5 | 0.5 | 500 μm |
| TAED agglomerate | 2.5 | 2.5 | 3.0 | — | — | — | — | — | 550 μm |
| SKS-6 powder | 3.5 | 3.5 | 9.0 | — | 3.5 | 5.0 | 5.0 | 5.0 | 60 μm |
| TAED powder | — | — | — | — | 1.5 | 2.0 | 3.0 | 3.5 | 80 μm |
| 3. Premix binder applied to the premix (2) | | | | | | | | | |
| PEG 4000 | 5.0 | | | | | | | | |
| PEG 1500 | | | | 6.0 | | | | | |
| AS, LAS, MBAS | | | | | 5.0 | 6.0 | 3.0 | 8.0 | |
| Water as binder (removed on drying) | | 10.0 | 15.0 | | | | | | |
| Other additives post-added to make the final detergent formulation: | | | | | | | | | |
| 4. Spray-on materials | | | | | | | | | |
| Perfume | 0.4 | 0.2 | 0.4 | 0.4 | 0.5 | 0.3 | 0.4 | 0.5 | |
| 5. Dry-added materials | | | | | | | | | |
| Premix (2) | 70.0 | 65.0 | 55.0 | 65.0 | 70.0 | 60.0 | 65.0 | 65.0 | |
| Enzymes (protease, lipolase, amylase, cellulase) | 2.0 | 1.5 | 1.0 | 1.3 | 1.2 | 1.5 | 1.3 | 1.0 | |
| NACAOBS | 3.0 | 2.5 | 3.0 | 3.5 | 3.5 | 2.5 | 3.5 | 3.0 | |
| Sodium percarbonate | 13.0 | 10.0 | 10.0 | 12.0 | 12.0 | 10.0 | 16.0 | 15.0 | |
| Photobleach | 0.02 | 0.02 | 0.02 | 0.02 | 0.02 | 0.02 | 0.03 | 0.03 | |
| Perfume encapsulates | 0.7 | 0.5 | 0.6 | 0.8 | 0.9 | 0.4 | 1.0 | 1.0 | |
| Citric acid | 6.0 | 4.0 | 2.0 | 4.0 | 6.5 | 5.0 | 6.0 | 6.5 | |
| Sodium carbonate speckle | 1.0 | 1.0 | 1.0 | 0.5 | 1.5 | 1.5 | 1.0 | 1.0 | |
| Zeolite A | 0.1 | — | — | 0.3 | — | — | — | — | |
| TAED agglomerate | — | — | — | 3.0 | — | — | — | — | |
| Silicone antifoam agglomerate | — | — | — | — | 3.0 | — | — | — | |
| 6. Coating Applied to premix (2) | | | | | | | | | |
| Burkeite (applied in 30 wt % aqueous solution) | 4.0 | 5.0 | 8.0 | — | 5.0 | — | 5.0 | 5.0 | |
| Brightener 15 | 0.1 | 0.1 | — | — | — | — | 0.1 | — | |
| Fillers up to 100% | | | | | | | | | |
| Finished product | | | | | | | | | |
| Geometric mean particle diameter | 600 μm | 600 μm | 600 μm | 800 μm | 800 μm | 600 μm | 600 μm | 600 μm | |
| Span (geometric standard deviation) | 1.4 | 1.2 | 1.4 | 1.2 | 1.4 | 1.6 | 1.4 | 1.4 | |

What is claimed is:

1. A bleaching granule for incorporation into a detergent composition comprising no more than 50 wt % of a particulate bleach component selected from bleach activators, bleach catalysts and mixtures thereof, and in addition, surfactant and/or builder and optional detergent ingredients and/or fillers the geometric mean particle diameter of the particulate bleach component being below 500 μm.

2. A bleaching granule according to claim 1 comprising no more than 30 wt % of a particulate bleach component.

3. A bleaching granule according to claim 1 in which the geometric mean particle diameter of the particulate bleach component is below 200 μm.

4. A bleaching granule according to claim 1 having a geometric mean particle diameter of from 200 μm to 2500 μm.

5. A bleaching granule according to claim 1 in which the bleach component comprises bleach activator and/or bleach catalyst either in solid form or on a solid carrier.

6. A bleaching granule according to claim 1 in which the bleach component comprises bleach activator.

7. A bleaching granule according to claim 1 in which the bleach activator is tetracetyl ethylene diamine (TAED).

8. A bleaching granule according to claim 1 comprising at least 15 wt % builder selected from aluminosilicates (zeolites), crystalline layered silicates and carboxylates.

9. A bleaching granule according to claim 1 comprising at least 5 wt % surfactant selected from anionic surfactants and nonionic surfactants or mixtures thereof.

10. A bleaching granule according to claim 1 which comprises both builder and surfactant which are present in the bleaching granule as a pre-formed particulate.

11. A detergent composition comprising a bleaching granule according to claim 1.

12. A method for making a bleaching granule according to claim 1 in which in a mixing step the particulate bleach component is mixed with builders and/or surfactants and optionally other detergent ingredients and/or fillers in a high, moderate or low shear mixer.

13. A method according to claim 12 in which the mixing step takes place in a moderate to low shear mixer.

* * * * *